United States Patent [19]

Kaindl

[11] 4,409,934

[45] Oct. 18, 1983

[54] INLET SUPPLY MANIFOLD FOR COMBUSTION ENGINE WITH 4- TO 6-CYLINDERS IN LINE

[76] Inventor: Wolfgang Kaindl, Blütenstr. 21, D-8052 Moosburg, Fed. Rep. of Germany

[21] Appl. No.: 253,841

[22] PCT Filed: Aug. 18, 1980

[86] PCT No.: PCT/EP80/00080

§ 371 Date: Apr. 17, 1981

§ 102(e) Date: Apr. 17, 1981

[87] PCT Pub. No.: WO81/00594

PCT Pub. Date: Mar. 5, 1981

[30] Foreign Application Priority Data

Aug. 17, 1979 [DE] Fed. Rep. of Germany ..... 2973331

[51] Int. Cl.[3] ..... F02B 75/18

[52] U.S. Cl. ..... 123/52 M; 123/59 R

[58] Field of Search ..... 123/52 K, 52 M, 52 MC, 123/59 R

[56] References Cited

U.S. PATENT DOCUMENTS 2,862,490 12/1958 Trisler ..... 123/52 M 4,175,504 11/1979 Ederer et al. ..... 123/52 M

FOREIGN PATENT DOCUMENTS 1526707 10/1969 Fed. Rep. of Germany .

1132643 8/1957 France .

2384120 10/1970 France .

*Primary Examiner*—Craig R. Feinberg

*Attorney, Agent, or Firm*—Craig & Burns

[57] ABSTRACT

An intake manifold is disclosed for 4- to 6-cylinder inline internal combustion engines. The manifold comprises a distribution chamber with essentially equally long individual intake pipes extending therefrom in two groups arranged approximately symmetrically to each other. The intake pipes have initial portions emanating from the distribution chamber approximately in one plane in pairwise mutual opposition, continuously curved intermediate portions, and mutually parallel end portions extending in the same direction with coupling ends for inlet ducts of an engine. The end portions of the intake pipes extend approximately at a right angle to the initial portions and substantially in a plane approximately parallel to the plane of the initial portions thereof. The intermediate portions of all the intake pipes include first elbows which start with the initial portions arranged within the one plane and extend in directions that have components that are directed away from the end portions, and further elbows adjoin the intermediate portions and form an approximately U-shaped connection with the end portions.

8 Claims, 5 Drawing Figures

INLET SUPPLY MANIFOLD FOR COMBUSTION ENGINE WITH 4- TO 6-CYLINDERS IN LINE

Figure 1:
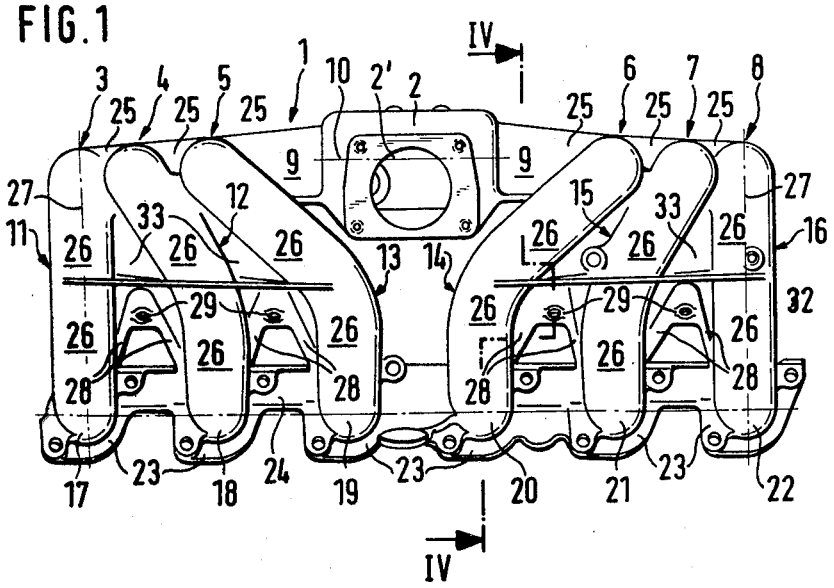

The invention relates to an intake manifold of the type having a distribution chamber with essentially equally long individual intake pipes extending therefrom in two groups arranged approximately symmetrically to each other, the intake pipes having initial portions emanating from the distribution chamber approximately in one plane in pairwise mutual opposition, continuously curved intermediate portions, and mutually parallel end portions extending in the same direction with coupling ends for inlet ducts of an engine, the end portions extending approximately at a right angle to the initial portions and substantially in a plane approximately parallel to the plane of the initial portions.

In conventional intake manifolds of this type of structure and similar types of construction (DOS No. 1,526,707, DOS No. 2,711,195, and U.S. Pat. No. 2,862,490), the curved intermediate portions adjoining the initial portions are always curved out of the plane of the initial portions in the direction toward the plane of the end portions, whereby the intended close, mutual spatial overlapping of the individual intake pipes is enhanced. However, such known arrangements are disadvantageous in that the intake pipe lengths, with a specific space requirement for the intake manifold, and due to the shaping conditions for an integrally manufactured casting are restricted and thus are not in all cases adequate for adaptation to the respectively necessary length.

It is an object of the invention to arrange the curved intermediate portions of the individual intake pipes with respect to their course in such a way that the total length of the intake pipes can be still further increased without considerable additional space requirement and without a close mutual spatial overlapping of the intake pipes impeding the one-piece casting manufacture, while at the same time providing that the individual intake pipes have an adequately large radii of curvature.

The invention attains this object in a surprisingly simple way which, however, is not made obvious by the state of the art by forming the intermediate portions of all intake pipes with first elbows which start with the initial portions arranged within the one plane of the initial portions of the intake pipes and extend in directions that have components that are directed away from the end portions, and wherein further elbows adjoin the intermediate portions and form an approximately U-shaped connection with the end portions. In this way, the intake pipes extend over their entire length within each group extensively mutually in parallel, wherein merely the mutual spacings, as seen over the length, initially decrease and then again increase. It is advantageous for the space requirement of the intake manifold that here the intake pipes of the end portions located externally in series determine the largest longitudinal dimension of the intake manifold installation, while these externally located intake pipes with their curved intermediate portions exhibit a smaller transverse dimension than the intake pipes for the end portions lying therebetween in the series. Thereby, a favorable space requirement is achieved for engine installation into automotive vehicles, because at both ends of the intake manifold there is space created for other auxiliary units.

In the conventional constructions according to DOS No. 1,526,707 and U.S. Pat. No. 2,862,490, the aforementioned spatial advantages are likewise provided; however, these constructions exhibit the spatial overlapping of the intake pipes, disadvantageous from the viewpoint of casting technique, as well as the small lengths of the intake pipes, disadvantageous for engine adaptation.

Figure 2:
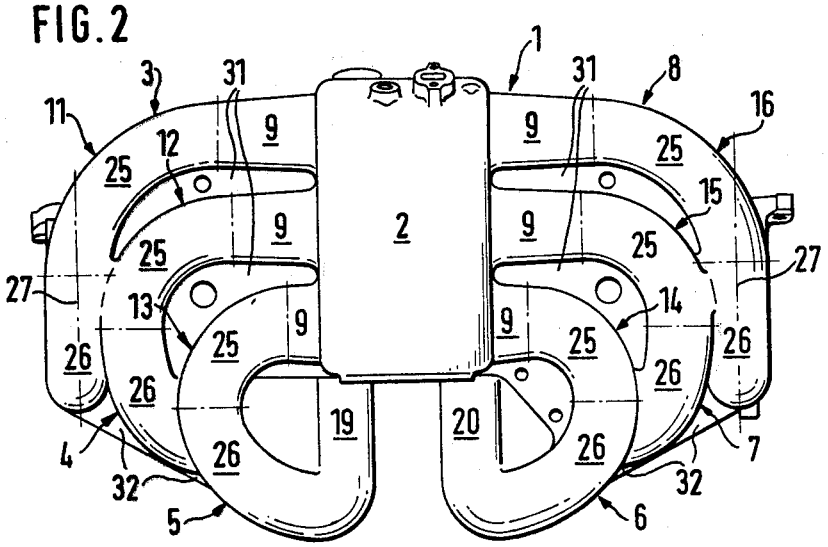
Figure 3:
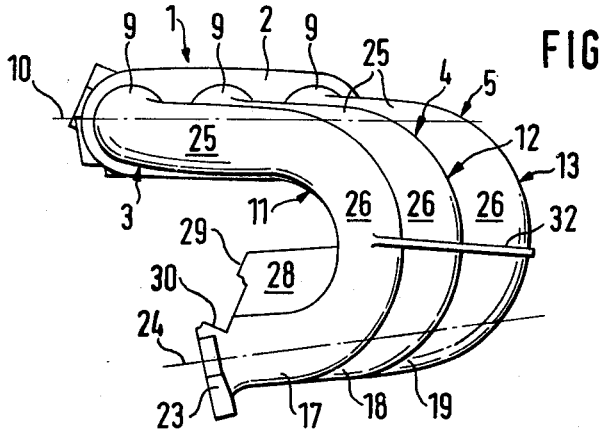
Figure 4:
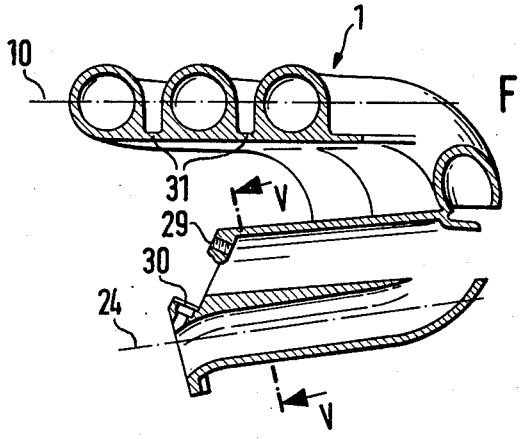
Figure 5:
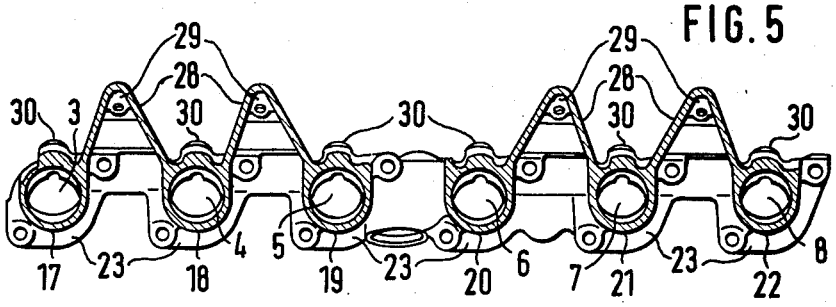

The drawing illustrates one embodiment of the invention. In the drawing:

FIG. 1 shows an end view of an intake manifold for a 6-cylinder in-line internal combustion engine, FIG. 2 shows a top view of the intake manifold of FIG. 1, FIG. 3 shows a lateral view of the intake manifold of FIGS. 1 and 2, FIG. 4 shows a section along line IV—IV in FIG. 1, and FIG. 5 shows a section along line V—V in FIG. 4.

Referring to the drawings, an intake manifold 1 for a 6-cylinder in-line injection internal combustion engine in the form of a gasoline engine, not shown, consists essentially of a distribution chamber 2 with an air inlet 2' and six individual intake pipes 3, 4, 5, 6, 7, and 8. Initial portions 9 of all equally long intake pipes 3-8 start in one plane 10 in parallel and in mutual pairwise opposition in two groups 3–5 and 6–8 from the distribution chamber 2. The intake pipes 3–8 include curved intermediate portions 11, 12, 13, 14, 15, and 16, extending far-reachingly in parallel to one another, as well as end portions 17, 18, 19, 20, 21, and 22 which, in turn, include coupling ends provided with flanges 23 which can be connected with inlet ducts of the internal combustion engine, not shown. The end portions 17–22 extend approximately in the same direction in parallel to one another and approximately in a plane 24 essentially parallel to the plane 10 of the initial portions 9 (FIG. 4). The inner cross section of the intake pipes 3–8 decreases continuously from the distribution chamber 2 to the coupling ends 17–22. The distribution chamber 2 is arranged approximately in the center across from the series of end portions 17–22. The curved intermediate portions 11–16 of the intake pipes 3–8 are composed of respectively first elbows 25 with a 90° curvature and respectively further elbows 26 forming an approximately U-shaped connection with the respective end portions 17–22 of the individual intake pipes 3–8. The further elbows 26 of the outer individual intake pipes 3 and 8 are constructed as planar 180° elbows, each of which lies in a plane 27 extending approximately at a right angle to the plane 10 of the initial portions 9, in which are also arranged the first elbows 25. The further elbows 26 of the inner intake pipes 4–7 diverge in a fan shape from their place of connection with the first elbows 25 toward the end portions 18–21. They are respectively composed of two 90° elbows which are rotated with respect to each other at their place of connection. In the area of these connecting places, the further elbows 26 simultaneously have a slight curvature transverse to the planes determined by their two 90° elbows. In the longitudinal direction of the end sections 17–22, approximately roof-shaped walls 28, directed toward the distribution chamber 2, are arranged between respectively two end sections 17 and 18, 18 and 19, 20 and 21, as well as 21 and 22 of the two groups 3–5 and 6–8 of the individual intake pipes 3–8. These simultaneously constitute a reinforcement, a mold partition between two casting molds, and within the area of the connecting ends or flanges 23 of the end portions 17–22, form at their apex ends respective a mounting place 29 with a female thread for parts of a fuel installation, not shown, such as injection nozzles and fuel distributor line, for which favorable space conditions prevail within the U-shaped further elbows 26. The flanges 23 of all end portions 17–22 are connected with each other for further reinforcement and are provided on their topsides with a respective mounting device a mounting means 30 for injection nozzles. The individual intake pipes 3–8 are connected with one another along the first elbows 25 by walls 31 and also transversely to the further elbows 26 by ribs 32 within the area of partial molded surfaces. Also the triangular interspaces 33 (FIG. 1) between the fan-like diverging parts of the further elbows 26 are closed off by walls. Difficult to control transitions as well as cleaning places between the transitions of the individual casting parts are avoided.

By the arrangement of the individual intake pipes according to the invention, a smooth transition is obtained from the intermediate portions 11–16 to the mutually parallel end portions 17–22, even though the spacings between the intake pipes 3–5 vary from an initial maximum value in the region of the first elbows 25 to a minimum value at the junction point between the first elbows 25 and the further elbows 26 and again to a second maximum value over the entire length of the end portions 17–22. Furthermore, possibility exists from this configuration of the intake pipes 3–8 to realize especially long lengths of these pipes without excessively expanding the space requirement for the entire intake manifold installation 1 in one direction, such as, for example, by the sole lengthening of the end portions 17–22. This arrangement has the advantage for the installation in an engine compartment of motor vehicles often restricted by auxiliary units, that the greatest longitudinal dimension does not go beyond the spacing of the connections to the external inlet ducts of an engine, whereas the transverse dimension decreases toward the longitudinal ends whereby favorable conditions result for the space requirements of other auxiliary units within the area of both end zones of the engine. Altogether, it is possible by means of this construction of the individual intake pipes to realize particularly great length of these pipes with an especially favorable space requirements.

While I have shown and described only one embodiment in accordance with the present invention, it is understood that the same is not limited thereto, but is susceptible to numerous changes and modifications as known to those skilled in the art, and I therefore do not wish to be limited to the details shown and described herein, but intend to cover all such changes and modifications as are encompassed by the scope of the appended claims.

I claim:

1. An intake manifold for 4- to 6-cylinder in-line internal combustion engines, comprising:

a distribution chamber and individual intake pipes of substantially equal length extending therefrom in two groups arranged approximately symmetrically to each other, said intake pipes including initial portions starting from the distribution chamber pairwise and mutually oppositely in an approximately common plane, substantially continuously curved intermediate portions, and mutually parallel end portions extending in a common direction having coupling ends for inlet ducts of an engine, the end portions extending approximately at a right angle to the initial portions and substantially in a plane approximately parallel to the plane of the initial portions, characterized in that the intermediate portions of all individual intake pipes include first eblows arranged substantially within said common plane which start from the initial portions and pass over substantially within said common plane into directions generally opposite said end portions, following a similar curved course, and in that further elbows of said intermediate portions which adjoin said, first elbows form an approximately U-shaped connection with the end portions.

2. An intake manifold according to claim 1, wherein the first elbows subtend an angle of approximately 90°.

3. An intake manifold according to claim 1, wherein the intermediate portions of the intake pipes in a respective group of the intake pipes closely approaches one another at the transition places between the first and the further elbows, and thereafter the further elbows of each group of the individual intake pipes diverge in a fan shape toward their spaced-apart end portions.

4. An intake manifold according to claim 1, wherein approximately roof-shaped walls extend in the longitudinal direction of the end portions between respectively two end portions, and wherein within the area of the coupling ends of the end portions, mounting means are provided at apex ends of the roof-shaped walls for parts of a fuel installation having at least one of injection nozzles and a fuel distributor line.

5. An intake manifold according to claim 1, wherein each of said initial portions starts from the distribution chamber in said common plane, each of said first elbows including a first portion connected to a respective initial portion and a second portion extending generally opposite said end portions, the first and second portions of said first elbows being disposed substantially in said common plane, and the second portions are connected with respective second elbows, and said end portions are disposed in planes approximately parallel to one another.

6. An intake manifold in which the intake pipes include two outer intake pipes and inner intake pipes according to claim 1, wherein the further elbows of the outer intake pipes of said manifold are constructed as planar 180° elbows and the further elbows of the inner intake pipes of said manifold are constructed as two mutually adjoining 90° eblows each.

7. An intake manifold according to claim 6, wherein two mutually adjoining 90° eblows of the further elbows of the inner intake pipes are rotated with respect to each other at their place of connection.

8. An intake manifold according to claim 6 or 7, wherein two mutually adjoining 90° elbows of the further elbows of the inner intake pipes have, at their place of connection, a slight curvature transversely to their respective planes.

* * * * *